United States Patent [19]

Landi et al.

[11] 3,950,261

[45] Apr. 13, 1976

[54] ANHYDROUS LIQUID IODOPHOR SOLUTION

[75] Inventors: Henry Patrick Landi, Yorktown Heights; Vincent Anthony Perciaccante, Long Island City, both of N.Y.

[73] Assignee: American Cyanamid Company, Stamford, Conn.

[22] Filed: May 29, 1975

[21] Appl. No.: 581,600

[52] U.S. Cl. ..... 252/106; 252/142; 252/DIG. 5; 424/150; 424/341

[51] Int. Cl.[2] ..... C11D 3/48

[58] Field of Search ..... 252/142, 106, DIG. 5; 424/150, 341

[56] References Cited

UNITED STATES PATENTS

| | | | |
|---|---|---|---|
| 3,150,096 | 9/1964 | Schmidt et al. | 252/106 |
| 3,274,116 | 9/1966 | Mills | 252/106 |
| 3,285,816 | 11/1966 | Kaplan et al. | 252/106 X |
| 3,338,837 | 8/1967 | Hodes | 252/106 |
| 3,438,905 | 4/1969 | Schmolka | 252/106 |
| 3,513,098 | 5/1970 | Cantor et al. | 252/106 |
| 3,663,694 | 5/1972 | Hall | 252/106 X |
| 3,728,449 | 4/1973 | Cantor et al. | 424/150 |

*Primary Examiner*—Harris A. Pitlick
*Attorney, Agent, or Firm*—Samuel Branch Walker

[57] ABSTRACT

A substantially anhydrous liquid iodophor detergent solution is used as a pre-surgical skin cleansing agent. This substantially anhydrous system in which the iodophor is stabilized by the addition of iodides can be incorporated easily into surgical scrub sponges without the expense, delay, and degradation of sponge material resulting from heating to remove the water of aqueous systems to produce a substantially anhydrous product that will not prematurely hydrolyze and deteriorate during prolonged storage.

2 Claims, No Drawings

ANHYDROUS LIQUID IODOPHOR SOLUTION

FIELD OF THE INVENTION

A substantially anhydrous germicidal iodophor detergent that is useful as a pre-surgical skin cleansing agent.

DESCRIPTION OF THE PRIOR ART

Germicidal preparations containing elemental iodine are well known. In fact, iodine is one of the oldest antiseptics in current use. Despite the present wide choice of antiseptics, iodine is still among the more valuable agents. Its use has survived on the basis of efficiency, economy and low tissue toxicity.

Although elemental iodine is the active germicide, the exact manner by which iodine exerts its effect is unknown. Iodine is rapidly germicidal. In the absence of organic matter, most bacteria are killed within one minute by exposure to a 1:20,000 concentration. Slightly longer times are required to kill bacterial spores. As to its effect on other microorganisms, tests have shown iodine to be an effective fungicide, viricide and amebicide.

Since iodine formulations exhibit broad spectrum germicidal activity with low tissue toxicity, they are particularly useful for the preoperative preparation of skin.

Normal skin is never free of microorganisms. The epidermis is host to both transient and indigenous varieties. Although transient flora are responsible for most infections, a resident variety could also be harmful if the integrity of the skin were violated. Therefore, it is fortunate that both can be removed, to a large extent, by a mechanical and chemical cleansing of the skin.

In the preoperative preparation of the area surrounding an incision, as well as the hands and forearms of operating room personnel, mechanical cleansing by vigorous scrubbing will remove most of the transient and a high percentage of resident flora. In addition, chemical cleansing with an iodine preparation will reduce further the number of organisms and greatly decrease the incidence or likelihood of infection.

There is a definite need for a disposable surgical scrub sponge which can be used with water to effectively cleanse and disinfect the hands and forearms of operating room personnel. It is advantageous for this product to be relatively inexpensive, easy to use and gentle to the skin. It is imperative that the product exhibit its germicidal effect quickly and effectively.

The prior art in this particular area illustrates the attempts that have been made to circumvent the presence of water in the packaged disposable scrub sponge.

Richter et al., U.S. Pat. No. 3,619,843 shows a non-aqueous process for impregnating surgical scrub sponges. By coating one surface of a sponge with dry particulate matter and piercing that surface with spikes or tines, the impregnate is physically driven into the inner cellular sponge structure.

Richter et al., U.S. Pat. No. 3,396,419 discloses an aqueous antibacterial formulation that is adsorbed into synthetic sponges and then dried in ovens at 80°C. to remove volatile components.

Applicants have overcome the inconvenient mechanical procedures in the prior art by developing a substantially anhydrous liquid iodophor system that can be formulated so as to be adsorbed easily and uniformly by a synthetic sponge material, commercially packaged, and stored for appreciable periods of time without incurring deterioration or significant loss in potency.

SUMMARY OF THE INVENTION

A substantially anhydrous liquid iodophor composition that can be incorporated into scrub sponges, packaged, and stored for prolonged periods of time is formed by:

1. free elemental iodine complexed with an ethylene oxide alkylphenol condensation product as a sustained release source of iodine and detergent;
2. a condensation product of ethylene oxide and an alkylphenol as additional detergent;
3. sodium iodide to stabilize the complexed elemental iodine, surprisingly so in the absence of water;
4. weak organic acids and salts thereof for pH control; and,
5. propylene glycol to solubilize all ingredients and to impart a viscosity ideally suited for impregnating polyurethane sponges for pre-surgical scrubbing.

DESCRIPTION OF THE PREFERRED EMBODIMENT

The germicidal activity in Applicants' invention is provided by a product from a class of materials known as "iodophors". The term is applied to any product in which surfactants act as carriers and solubilizing agents for iodine.

During the pre-surgical scrub procedure, contact with water causes the iodophor to liberate iodine. The sustained release of iodine for the duration of the prescribed scrub prolongs the germicidal activity resulting in the removal of pathogens. Iodine harnessed as an iodophor, exhibits a reduced vapor pressure and odor. Iodophors also permit substantial dilution with water and staining is almost non-existent.

As a preferred source of elemental iodine, Applicants employ a nonylphenoxypoly (ethyleneoxy) ethanol-iodine complex consisting of at least one condensation product of ethylene oxide and an alkyl phenol in which the alkyl group has from 5 to 15 carbon atoms in a straight chain and containing $20 \pm 2\%$ available iodine. One such complex is Biopal VRO-20. Understandably, the concentration of available iodine in the final preparation will be about $4.2 \pm 0.4\%$ as a result of dilution by the addition of the other ingredients.

Although the ethylene oxide linear alkylphenol is a detergent and, in part, acts as such, an additional detergent is present which consists of the ethylene oxide condensation product of an alkylphenol such as nonylphenol or other alkylphenol in which the alkyl group, preferably a straight chain, is from about 5 to 15 carbon atoms in length, with sufficient ethylene oxide to give a detergent which is near the water-soluble oil soluble balance point. One such detergent is Igepal CO-630.

To stabilize the elemental iodine suspended in the non-ionic surfactant, Applicants have added a small quantity of sodium iodine based on the quantity of available iodine. The presence of iodides has been shown to prevent the loss of available iodine from the iodophor in an aqueous system. Applicants have now found that it is equally effective in the substantially non-aqueous system of the present invention.

Since stability and effectiveness of the iodophor are enhanced at a lower pH, an acidic material is added to the composition. Weak organic acids and salts thereof, such as citric acid or acetic acid, give effective pH control in a range of about 3 to 5.5; however, a lower range of about 3 to 4 would be preferred. While alkalinity has been associated with the symptoms of dishpan hands, this mildly acidic formulation is gentle to skin under all conditions of use.

Applicants have selected propylene glycol to solubilize all ingredients and to achieve a viscosity that is convenient and easy to work with. Since this iodine preparation is introduced into the cellular confines of scrub sponges, propylene glycol has the advantage of being fluid enough to be adsorbed quickly yet viscous enough to remain adsorbed.

Ideally, this system, as finally formulated should be completely anhydrous to avoid product deterioration by hydrolysis. However, as a practical matter, the presence of a very small amount of water is unavoidable. There is water of hydration in the sodium acetate; water is present as an impurity in commercially available propylene glycol and a small amount is of atmospheric origin. As a result, the concentration of water in the final detergent formulation should not be greater than 5% w/w and preferably below 3% w/w.

EXAMPLE 1

A substantially anhydrous iodophor detergent formulation is prepared from the following ingredients:

| | Wt. % |
|---|---|
| Propylene glycol, U.S.P. | 30.0 |
| Citric acid (anhydrous powder), U.S.P. about qs to produce a pH of between 3 and 4 | 1.0 |
| Igepal CO-630 | 43.0 |
| Sodium acetate, U.S.P. ($NaC_2H_3O_2\ 3H_2O$) | 2.0 |
| Biopal VRO-20 | 22.0 |
| Sodium iodide, U.S.P. | 2.0 |
| | 100.0 |

The following chart illustrates the stability of elemental iodine when formulated according to the precepts of the present invention.

Stability Study
Anhydrous Iodophor Detergent Formulation
as Detailed in Example 1
Room Temperature

| | pH | % $I_2$ |
|---|---|---|
| | 5.3 | 4.44 |
| 1 week | 5.25 | 4.39 |
| 2 weeks | 5.3 | 4.42 |
| 3 weeks | 5.25 | 4.40 |
| 1 month | 5.25 | 4.42 |
| 2 months | 5.1 | 4.37 |

-continued

Stability Study
Anhydrous Iodophor Detergent Formulation
as Detailed in Example 1
Room Temperature

| | pH | % $I_2$ |
|---|---|---|
| 3 months | 5.0 | 4.29 |
| 4 months | 4.9 | 4.23 |
| 5 months | 5.0 | 4.23 |
| 6 months | 5.0 | 4.00 |
| 9 months | 5.0 | 4.07 |
| 12 months | 4.7 | 3.99 |
| 18 months | 4.9 | 3.91 |

% $I_2$ was determined by titrating 2–5 gram samples in 100 ml. of anhydrous methanol.

The following chart illustrates the instability of elemental iodine in a substantially anhydrous system without sodium iodide.

Stability Study - Anhydrous Iodophor
Room Temperature

| | pH | % $I_2$ |
|---|---|---|
| | 4.8 | 3.61 |
| 1 week | 4.6 | 3.26 |
| 2 weeks | 4.55 | 3.1 |
| 3 weeks | 4.5 | 2.9 |
| 1 month | 4.4 | 2.89 |
| 2 months | 4.35 | 2.69 |
| 3 months | 4.3 | 2.53 |
| 5 months | 4.2 | 2.48 |
| 8 months | 4.25 | 2.37 |
| 10 months | 4.1 | 2.34 |
| 12 months | 3.9 | 2.24 |
| 18 months | 4.1 | 2.20 |
| 24 months | 4.0 | 2.16 |

% $I_2$ was determined by titrating 2–5 gram samples in 100 ml. of anhydrous methanol.

I claim:

1. A substantially anhydrous liquid iodophor detergent solution comprising:

propylene glycol, about 30% by weight, a nonionic detergent consisting of at least one condensation product of ethylene oxide and an alkylphenol, said alkyl group having from 5 to 15 carbon atoms in a straight chain, about 43% by weight, an iodine complex of an ethylene oxide alkylphenol condensation product, having about 20% by weight available iodine, said alkyl having from about 5 to 15 carbon atoms in a straight chain, about 22% by weight.

sodium acetate, about 2% by weight, sodium iodide, about 2% by weight, and citric acid in sufficient quantity to produce a pH of between about 3 and 5.5.

2. A detergent solution according to claim 1 in which the citric acid is added in sufficient quantity to produce a pH of between about 3 and 4.

* * * * *